US005946729A

United States Patent [19]

Sakurai et al.

[11] Patent Number: 5,946,729

[45] Date of Patent: Sep. 7, 1999

[54] RUCKSACK WITH DISASTER-PROTECTION HOOD

[76] Inventors: Tadayoshi Sakurai, 5-28-3, Nishinippori, Arakawa-ku; Shoju Enomoto, 2-26-6, Kaminakazato, Kita-ku, both of Tokyo, Japan

[21] Appl. No.: 09/083,059

[22] Filed: May 22, 1998

[30] Foreign Application Priority Data

May 24, 1997 [JP] Japan ..... 9-150155

[51] Int. Cl.[6] ..... A45F 4/02

[52] U.S. Cl. ..... 2/202; 2/410; 2/DIG. 3; 224/153; 224/576; 224/655; 224/642

[58] Field of Search ..... 2/410, 413, 455, 2/456, 69, 84, 202, 205, 204, 209.3, DIG. 3; 224/153, 576, 655, 642

[56] References Cited

U.S. PATENT DOCUMENTS

| | | | |
|---|---|---|---|
| 4,192,030 | 3/1980 | Cason | 5/420 |
| 4,324,005 | 4/1982 | Willis | 2/413 |
| 5,050,240 | 9/1991 | Sayre | 2/6 |
| 5,165,111 | 11/1992 | Lieberman | 2/94 |
| 5,428,845 | 7/1995 | Deagan | 2/413 |
| 5,673,836 | 10/1997 | Bush | 224/576 |
| 5,676,293 | 10/1997 | Farris | 224/576 |
| 5,720,051 | 2/1998 | Johnson | 2/413 |
| 5,784,719 | 7/1998 | Robinson | 2/94 |
| 5,794,263 | 8/1998 | Carman | 2/84 |

FOREIGN PATENT DOCUMENTS 2197582 5/1988 United Kingdom .

*Primary Examiner*—John J. Calvert
*Assistant Examiner*—Tejash D Patel
*Attorney, Agent, or Firm*—Wenderoth, Lind & Ponack, LLP

[57] ABSTRACT

A rucksack is provided with a disaster-protection hood attached to the rucksack body. When not in use the hood is folded away in a strip between the rucksack body and the hood. A gas charging apparatus with a compressed carbon dioxide cylinder when operated, inflates the hood to form a disaster-protection hood in which the back of the neck the and each side of the face are protected by the cushioning imparted by such inflation.

6 Claims, 11 Drawing Sheets

RUCKSACK WITH DISASTER-PROTECTION HOOD

BACKGROUND OF THE INVENTION

1. Field of the Invention

The present invention relates to a rucksack that includes a disaster-protection hood.

2. Description of the Prior Art

Various rucksacks which carry a disaster-protection hood have been proposed. However, when it comes to an emergency situation such as the major earthquake in Kobe, there is no rucksack in which a hood is carried in a way that enables the hood to be used promptly to protect the head by means of a simple operation that can readily be done by anyone regardless of age or whether the user is physically impaired. There is therefore a need for such a rucksack.

The object of the present invention is to provide a rucksack which carries a disaster-protection hood in a way that, in the event of an earthquake, a fire, a flood, a volcanic eruption or other such disaster, can be promptly and easily used by all, whether the user is old, or young, or physically impaired.

SUMMARY OF THE INVENTION

To attain the above object, the present invention provides a rucksack with a disaster-protection hood comprising a rucksack body, a hood, a hood containment strip between the hood and the rucksack body. The hood containment strip is connected at one end to a lower edge of the nape-of-neck cover portion of a hood by a zipper and at the other end to the rucksack body via a connective strip, with the front of the hood and the back of the rucksack body facing in the same direction. The hood containment strip is provided around its periphery with a fastening structure so that when the hood containment strip is folded over, peripheral edges enter into mutual engagement to form a containment enclosure to contain the hood. A gas charging apparatus has a compressed carbon dioxide cylinder that when operated charges the hood with carbon dioxide gas to form a disaster-protection hood in which a nape-of-neck cover portion, a head-cover portion and face side flaps constituting the hood function as a gas cushion.

The above object is also attained with the above rucksack in which the fastening structure is a fastener of the touch-close type (IPC classification A44B 18/00). Fasteners of the touch-close type referred to herein are a fastener comprised of a pair of strips of flexible tape, one being male type tape and the other being female type tape. Male type tape has a surface provided with numerous hooks, and female type tape has a surface provided with numerous loops into which the hooks of the male type tape engage when the male and female type tapes are pressed together face to face.

The above object is also attained with the above rucksack in which the hood containment strip is detachably attachable.

Further features of the invention, its nature and various advantages will be more apparent from the accompanying drawings and following detailed description of the invention.

DESCRIPTION OF THE PREFERRED EMBODIMENT

The present invention will now be described with reference to the drawings.

Figure 1:
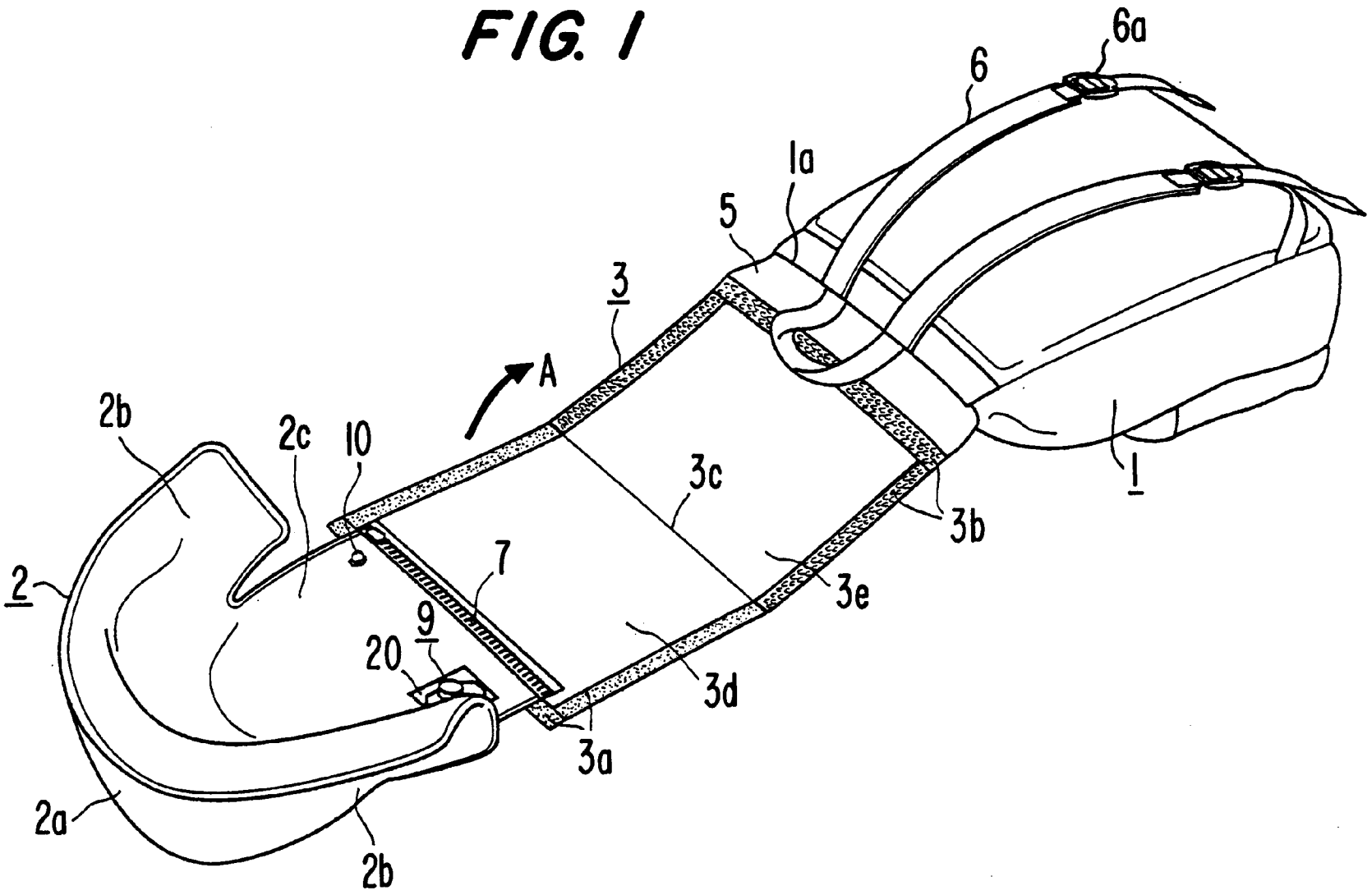
FIG. 1 is a perspective view of the rucksack with disaster-protection hood of the present invention in an open state, showing a connecting arrangement of the hood, a hood containment strip and a rucksack body.
Figure 2:
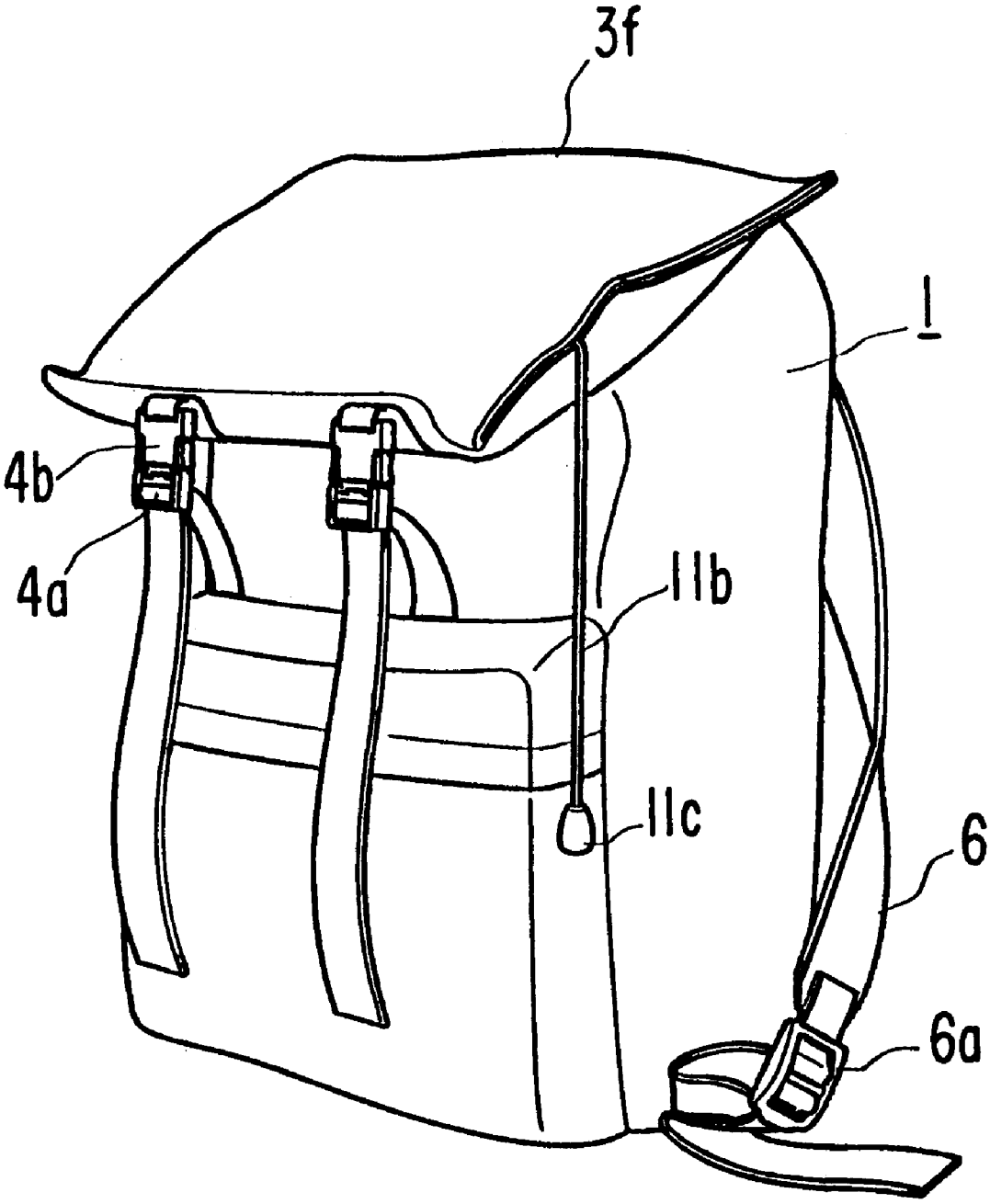
FIG. 2 is a perspective view of the rucksack of the present invention seen from the front.
Figure 3:
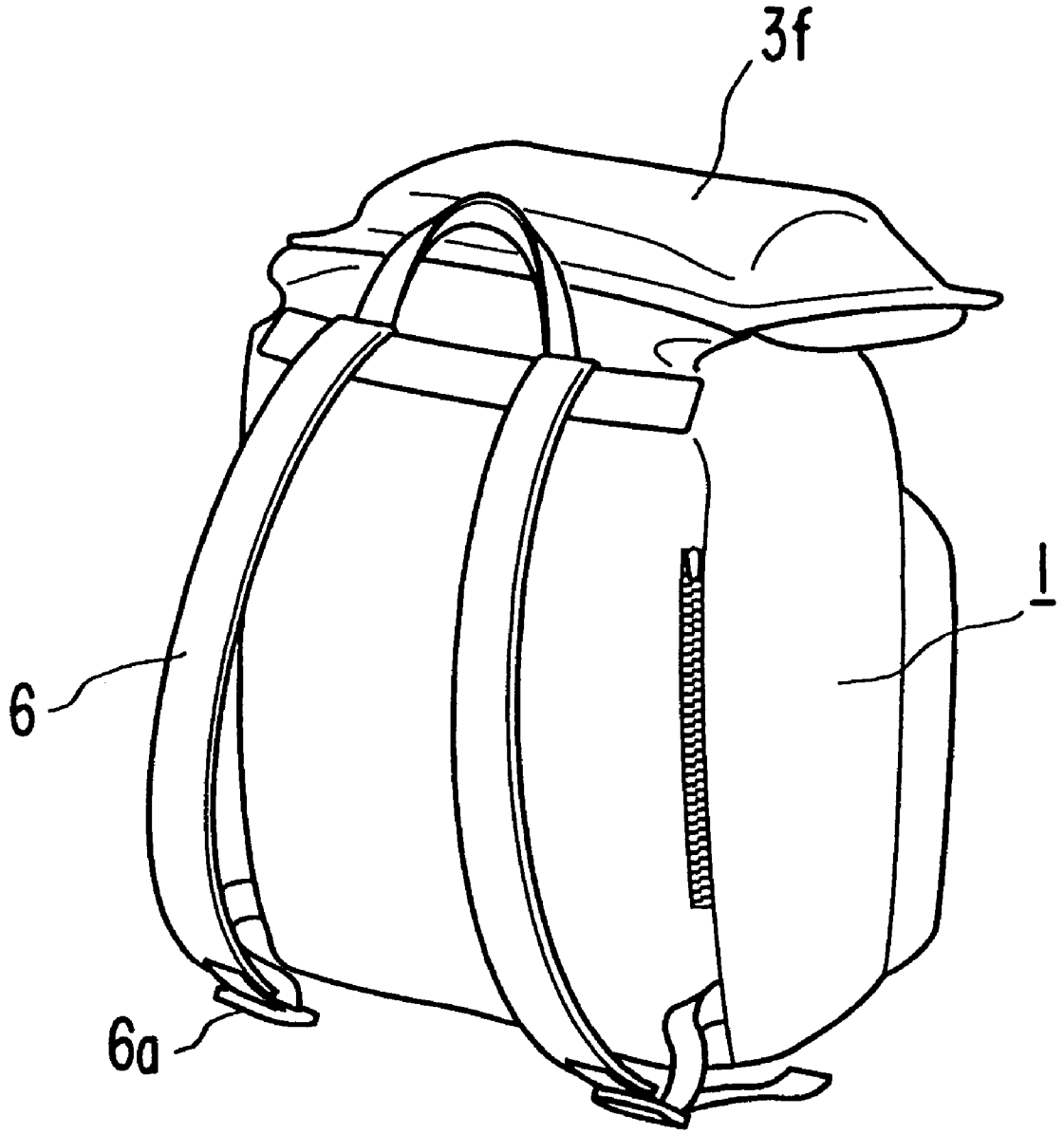
FIG. 3 is a perspective view of the rucksack of the present invention seen from the back.
Figure 4:
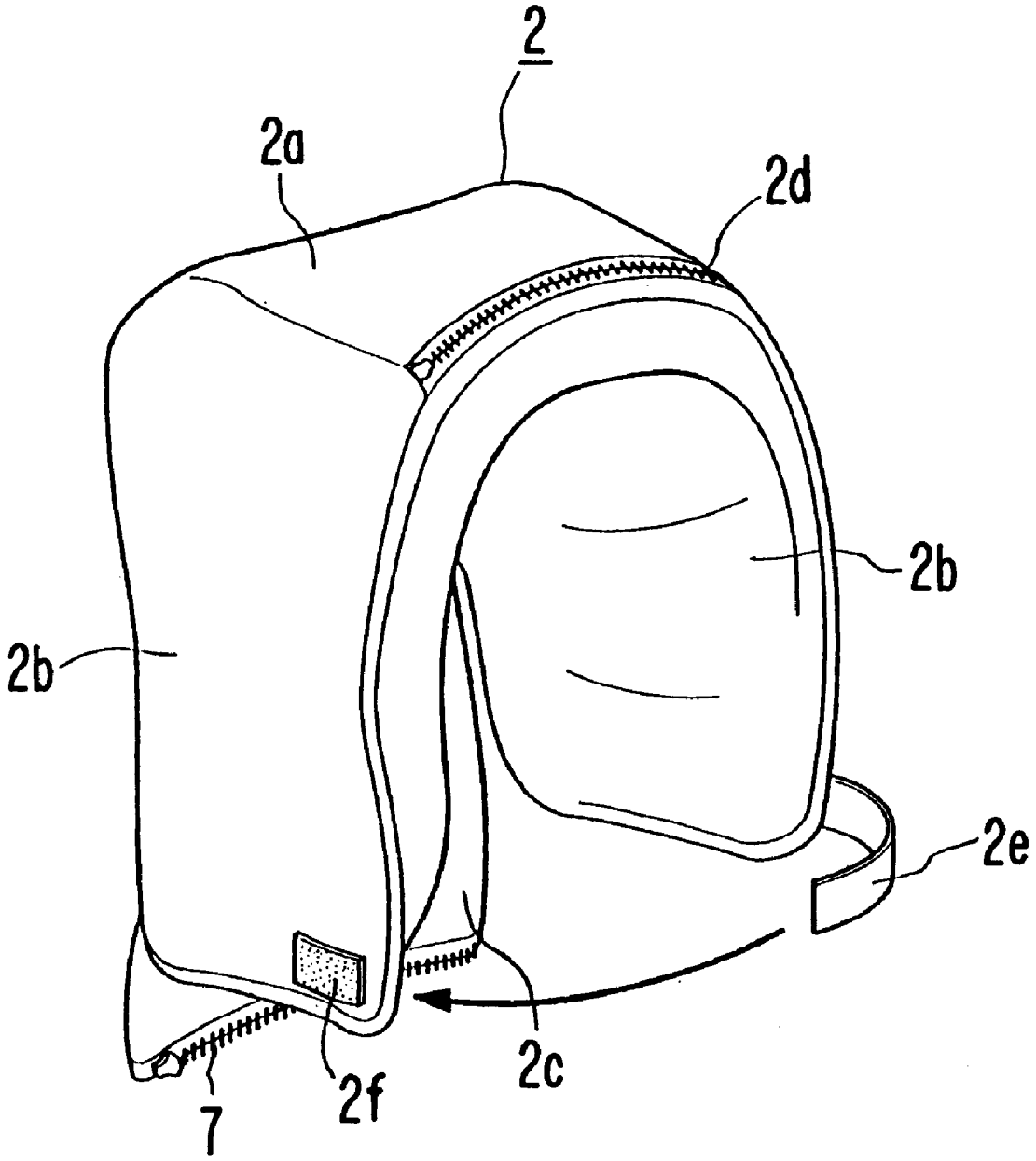
FIG. 4 is a perspective view of the hood when a gas bag is filled with gas, imparting a cushioning function to the hood.
Figure 5:
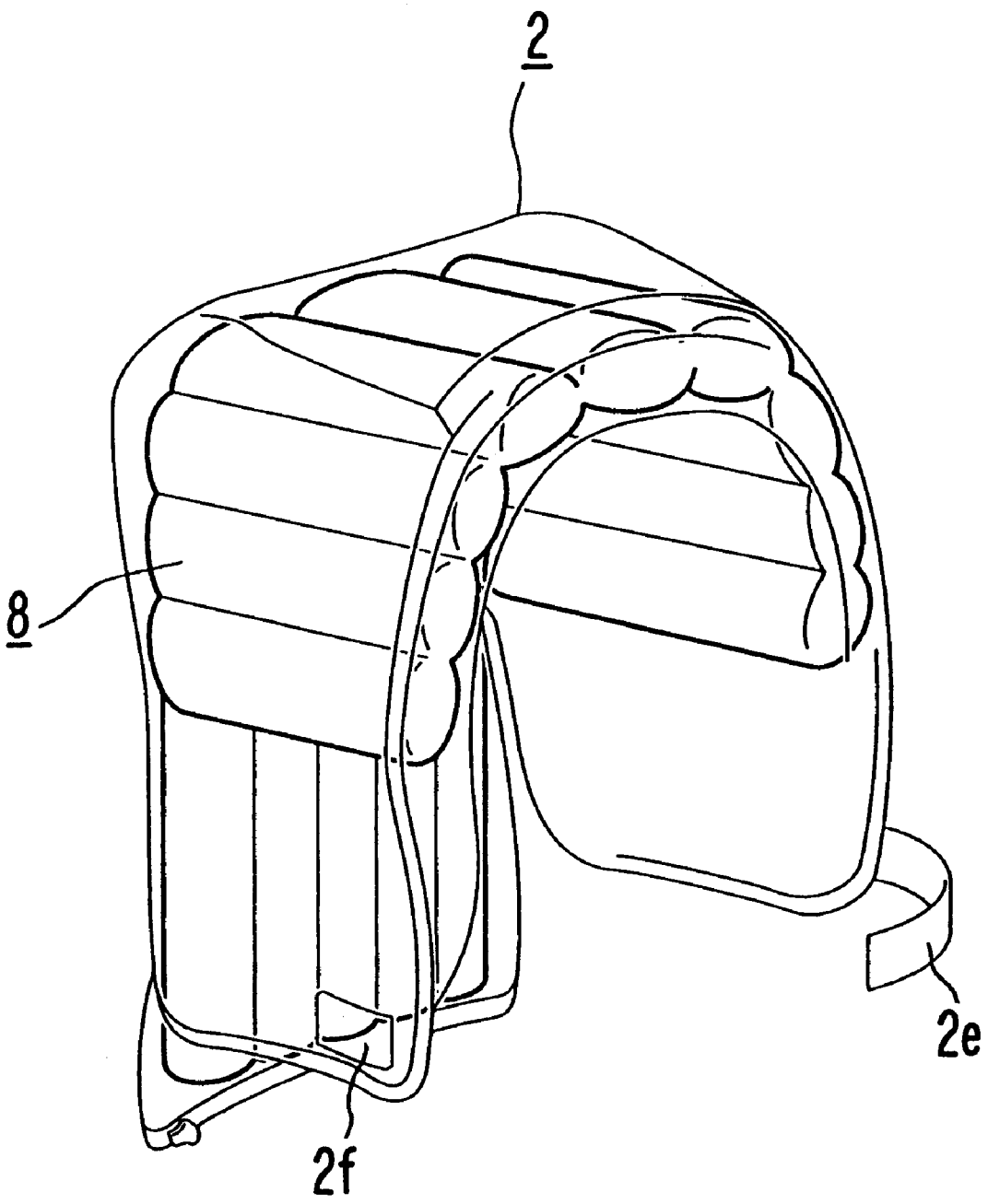
FIG. 5 is a transparent view of the hood when the gas bag in the hood has been fully inflated by operation of the gas charging apparatus.
Figure 6:
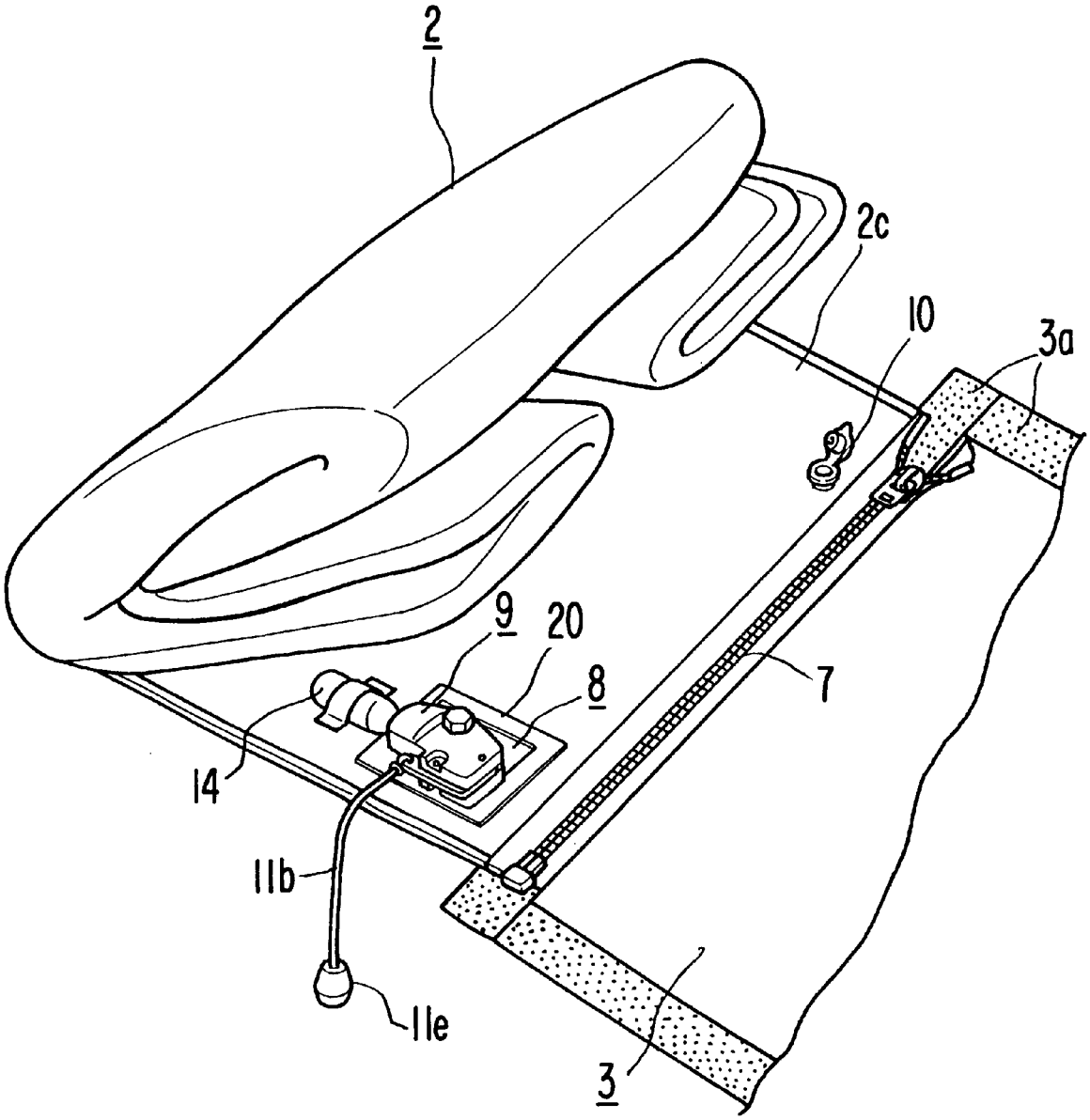
FIG. 6 is a perspective view showing how the hood is folded within the hood containment strip.
Figure 7:
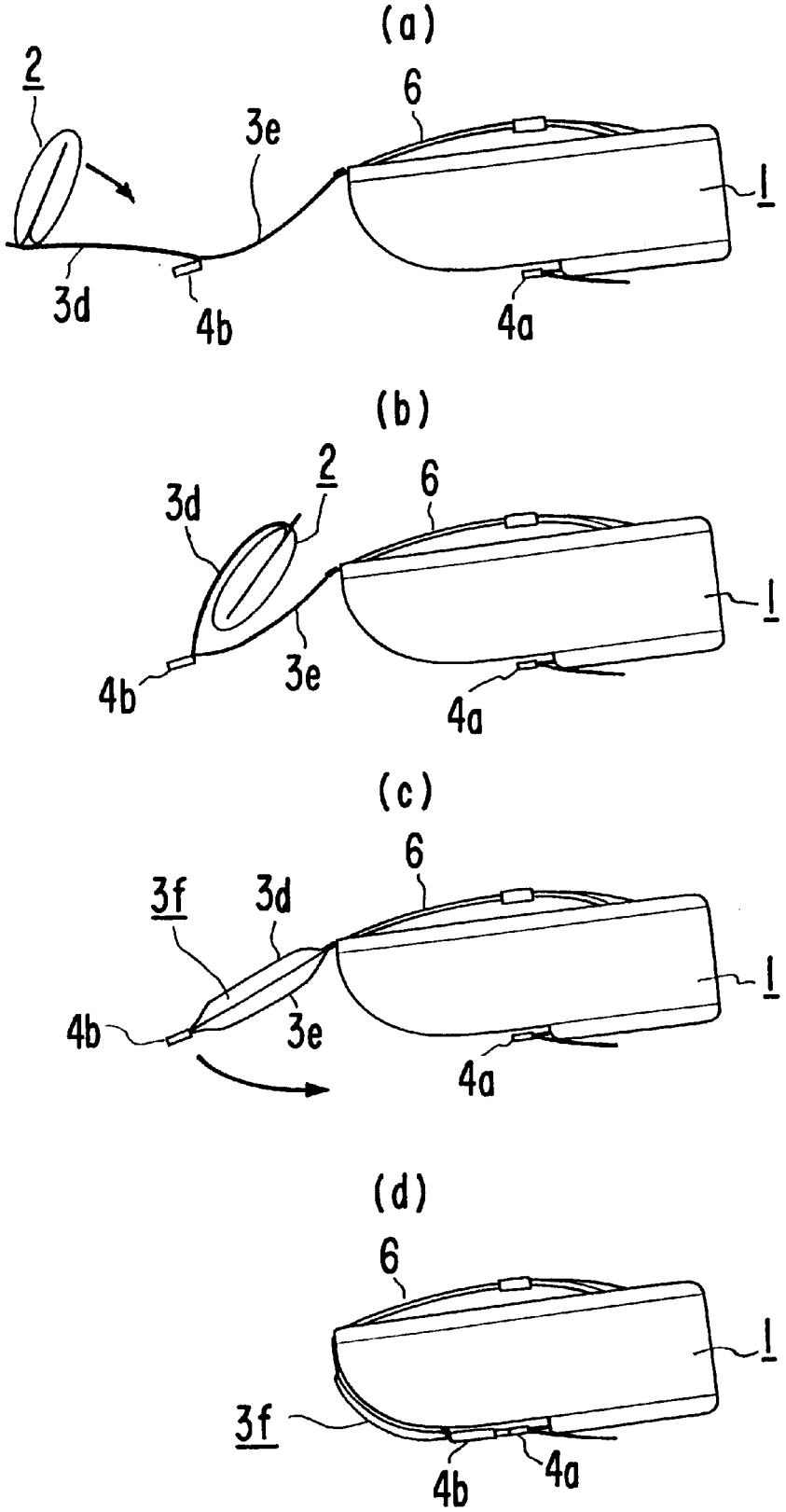
FIG. 7(*a*)–7(*d*) are schematic views that illustrate the process of fitting the hood into the hood containment strip.
Figure 9:
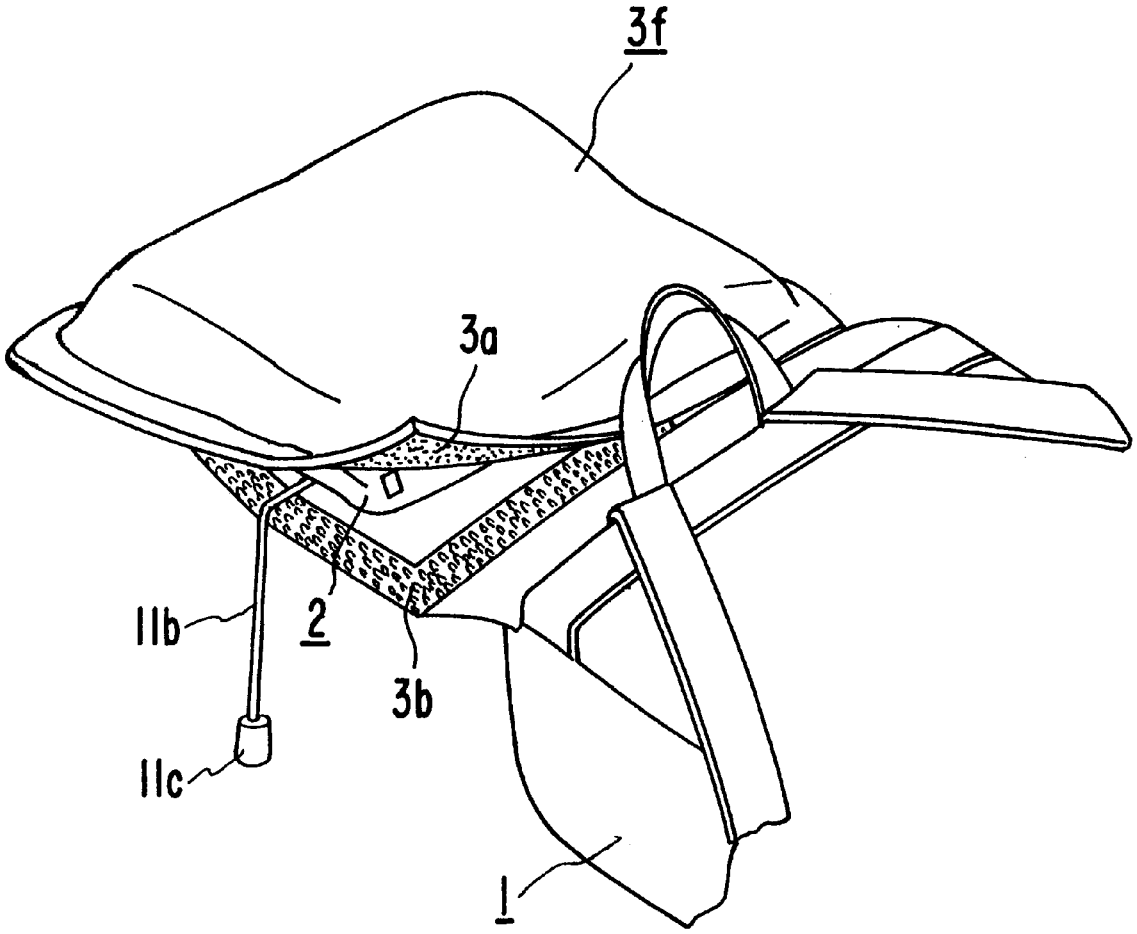
FIG. 9 is a perspective view of the state when the hood is packed away in the hood containment strip, which is shown partly open.
Figure 10:
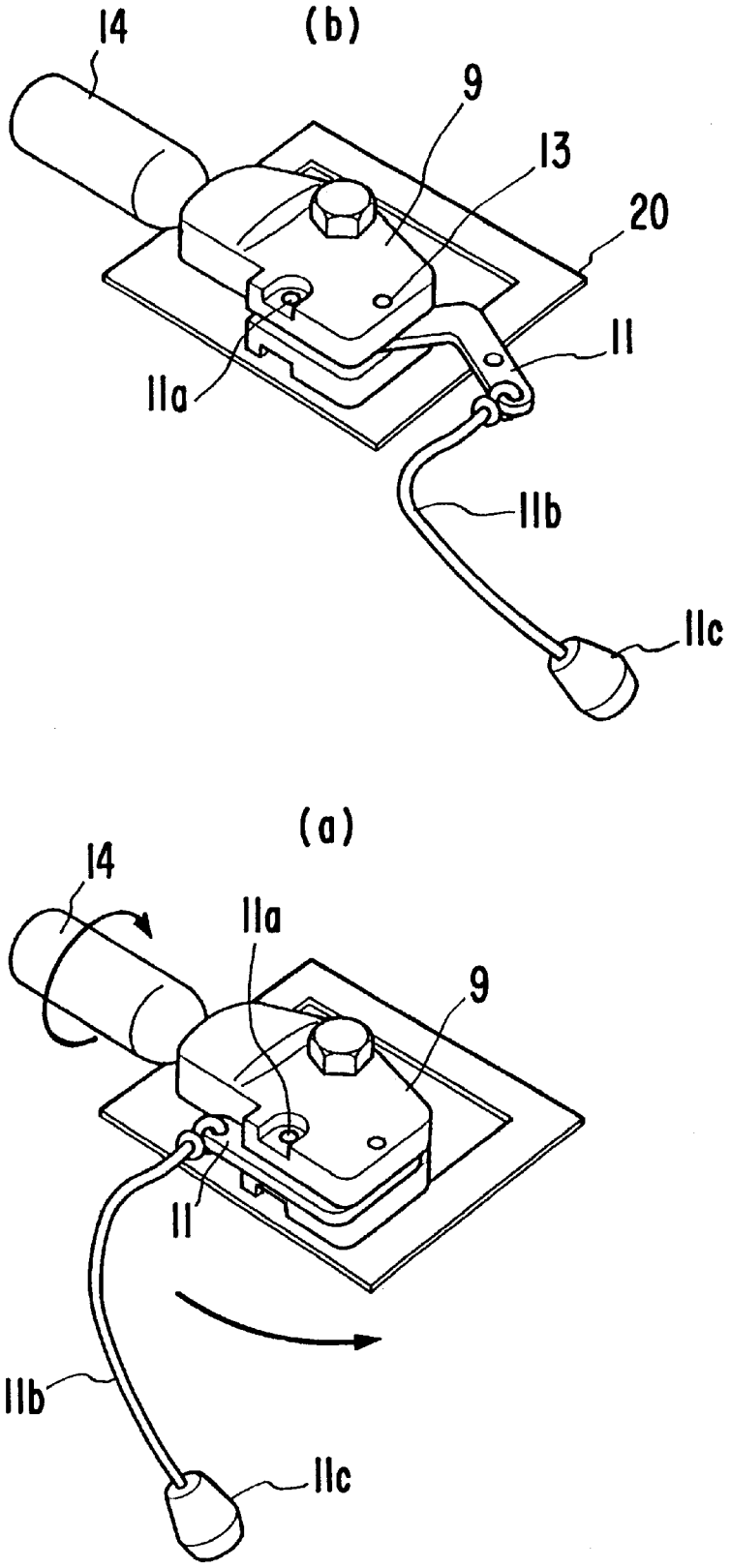
FIG. 10(*a*)–10(*b*) are perspective views of the external structure of a gas charging apparatus.

FIG. 1 shows a connective arrangements of the disaster-protection hood 2, hood containment strip 3 and rucksack body 1. FIG. 2 is a perspective view of the front of the rucksack of the invention and FIG. 3 is a perspective view of the back of the rucksack. FIG. 4 is a perspective view of the exterior aspect of the hood 2 when a gas bag 8 is filled with gas, imparting a cushioning function to the hood. FIG. 5 is a perspective view of the hood 2 when a gas charging apparatus 9 has been operated, inflating the gas bag 8 contained in, a bag-like space between double fabric walls of the hood 2 integrally formed by the expanse of head, side, and nape-of-the-neck portions thereof. FIG. 6 is a perspective view of the hood 2 folded for fitting into the hood containment strip 3. FIGS. 7(*a*) to 7(*d*) illustrate the process of fitting the hood 2 into the hood containment strip 3 for carrying, and FIGS. 8(*a*) to 8(*c*) show how the hood containment strip 3 is arranged when the hood 2 is in use. FIG. 9 is a perspective view of when the hood 2 has been packed away in the hood containment strip 3, which is shown with one portion open. FIGS. 10(*a*) and 10(*b*) show the external structure of the gas charging apparatus 9, and FIGS. 11(*a*) and 11(*b*) show the internal structure of the gas charging apparatus 9.

The rucksack body 1 is shown in FIGS. 1, 2 and 3, while FIGS. 4 and 5 show the hood 2 comprised of a head-cover portion 2*a*, face side flaps 2*b* and nape-of-neck cover portion 2*c*, whereby the hood 2 integrally covers the head portion, both sides of the face and the nape of the neck of a wearer. The hood 2 is formed of two layers of fabric that are stitched to form a bag-like space in which there is a gas bag 8 (FIG. 5) that when charged with gas forms a cushion in the shape of the hood 2. When not in use, the hood 2 is carried in a deflated state. In the drawings, 6 denotes a backstrap and 6*a* a buckle.

The gas bag 8 is comprised of a plurality of small, mutually-communicating compartments and is provided with a manually-operated gas charging apparatus 9 (FIGS.

10 and 11) provided with a small gas cylinder 14 for holding compressed carbon dioxide gas, and a gas stopper valve 10 for exhausting the gas.

As shown in FIG. 6, the gas charging apparatus 9 is affixed to a part of the gas bag 8 that can be seen via a gas charging apparatus fixing hole 20 provided at the lower part of the nape-of-neck cover portion 2*c* of the hood 2, and the gas bag 8 is also in communication with the gas stopper valve 10 used for hood deflation, also located at the lower part of the nape-of-neck cover portion 2*c*.

As shown in FIG. 4, an opening 2*d* with a zipper is provided at the top front part of the hood 2 to allow the gas bag 8 to be removed from, or inserted into, the enclosed space within the hood 2. A chinstrap 2*e* is provided at the lower end of the side flap 2*b* on the left side of the face. Attached to the chinstrap 2*e* is a male piece of one of the fasteners of the touch-close type to allow the chinstrap 2*e* to be fastened to a fixing portion 2*f* comprised of a corresponding female piece of one of the fasteners of the touch-close type provided on the right-side flap 2*b*, to thereby hold the hood 2 in place.

The present invention is characterized by the hood containment strip 3 used to house the hood 2 and being disposed between the hood 2 and the rucksack body 1.

Thus, as shown in FIG. 1 the hood containment strip 3 is disposed between the hood 2 and the rucksack body 1 so that the front of the hood 2 and the back of the rucksack body 1 face in the same direction. One end of the hood containment strip 3 is connected to the nape-of-neck cover portion 2*c* of the hood 2 by a zipper 7, and the other end of the hood containment strip 3 is connected to the rucksack body 1 via connective strip 5 that runs along the rear upper edge 1*a* of the rucksack body 1. When the hood 2 is folded as shown in FIG. 6, the hood containment strip 3 is sufficiently wide and long to accommodate the hood 2 within an enclosure space formed when the hood 2 is placed on a folding portion 3*d* and the hood containment strip 3 is folded along the center line 3*c* so that the folding portion 3*d* folds over onto a folding portion 3*e*. A fastening means is provided along opposed edges of the folding portion 3*d* and folding portion 3*e* to enable the folding portion 3*d* and the folding portion 3*e* to be attached together to form the space in which the folded hood 2 is accommodated.

Fasteners of the touch-close type may be used as the fastening means. For example, male type tape 3*a* may be provided around the edge of the folding portion 3*d* and female type tape 3*b* around the edge of the folding portion 3*e*. The zipper 7 should be attached at a position that ensures that a sufficient width of the male type tape 3*a* remains along the edge of the hood containment strip 3, as shown in FIG. 6.

The hood containment strip 3 is used to connect the hood 2 with the rucksack body 1 with the front of the hood 2 facing the same way as the back of the rucksack body 1 because it is a convenient configuration for inserting the folded hood 2 in the bag-like space formed by the strip 3, and also because, in an emergency, the hood 2 can be inflated into the position of use by operating the gas charging apparatus 9 without having to first remove the rucksack.

FIGS. 7(*a*) to 7(*d*) illustrate the process of fitting the folded hood 2 into the hood containment strip 3. As shown in FIG. 7(*a*), the hood 2 is rolled in the direction of the arrow B onto the folding portion 3*d* of the hood containment strip 3, then onto folding portion 3*e* (FIG. 7(*b*)). Then, as shown in FIG. 7(*c*), the folding portion 3*d* is folded right over onto the folding portion 3*e*, enclosing the hood 2 in the space therebetween, and the edges are pressed together. As the edges are provided with fasteners of the touch-close type, this attaches the edges together, forming a hood pocket 3*f* which is rolled in the direction shown by arrow C, effecting engagement between male buckle 4*a* and female buckle 4*b*, resulting in the state shown by FIG. 7(*d*).

FIG. 2 is a perspective view of the rucksack state shown in FIG. 7(*d*). In the view shown in FIG. 9, a portion of the enclosure is shown open to be able to see the hood 2 in place inside the hood pocket 3*f*. 3*a* may be the male type tape and 3*b* the female type tape, or vice-versa.

Figure 8:
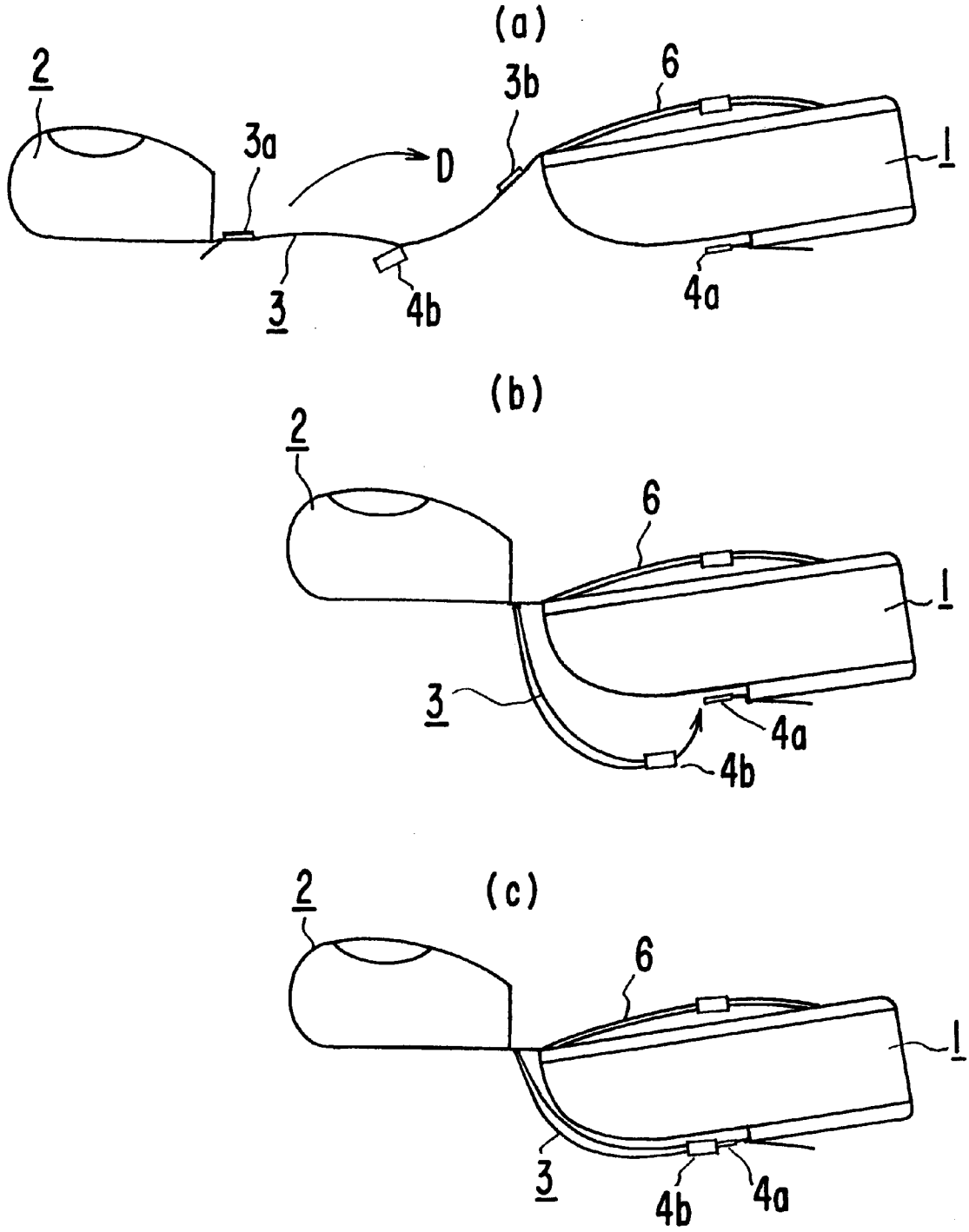
FIG. 8(*a*)–8(*c*) are schematic views that illustrate how the hood containment strip is arranged when the hood is in use.

FIGS. 8(*a*) to 8(*c*) illustrate the arrangement of the hood containment strip 3 when the hood 2 is inflated for use. When the gas charging apparatus 9 is operated, the gas bag 8 within the hood 2 is charged with the gas, inflating the hood 2. Under the force of the inflationary pressure, the fasteners of the touch-close type that had been holding the hood containment strip 3 folded over separate, allowing the hood 2 to pop out. This is the state shown by FIG. 8(*a*), with the hood containment strip 3 opened out. The hood containment strip 3 is then folded in the direction shown by arrow D, thereby locking the strips of male type tape 3*a* and female type tape 3*b* together, as in FIG. 8(*b*). Then, as shown in FIG. 8(*c*), male buckle 4*a* and female buckle 4*b* are brought into engagement. In this state the hood containment strip 3 functions as a cover for the rucksack body 1 and also serves to protect the nape of the neck of the wearer.

FIGS. 10(*a*) and 10(*b*) are perspective exterior views of the gas charging apparatus 9, with FIG. 10(*a*) showing the gas charging apparatus 9 before it is operated and FIG. 10(*b*) showing the gas charging apparatus 9 after it is operated. 11 denotes a lever, 11*a* is a safety pinhole, 11*b* is a pull-cord, 11*c* is a pull-piece, 13 is a shaft and 14 is a compressed carbon dioxide cylinder.

Figure 11:
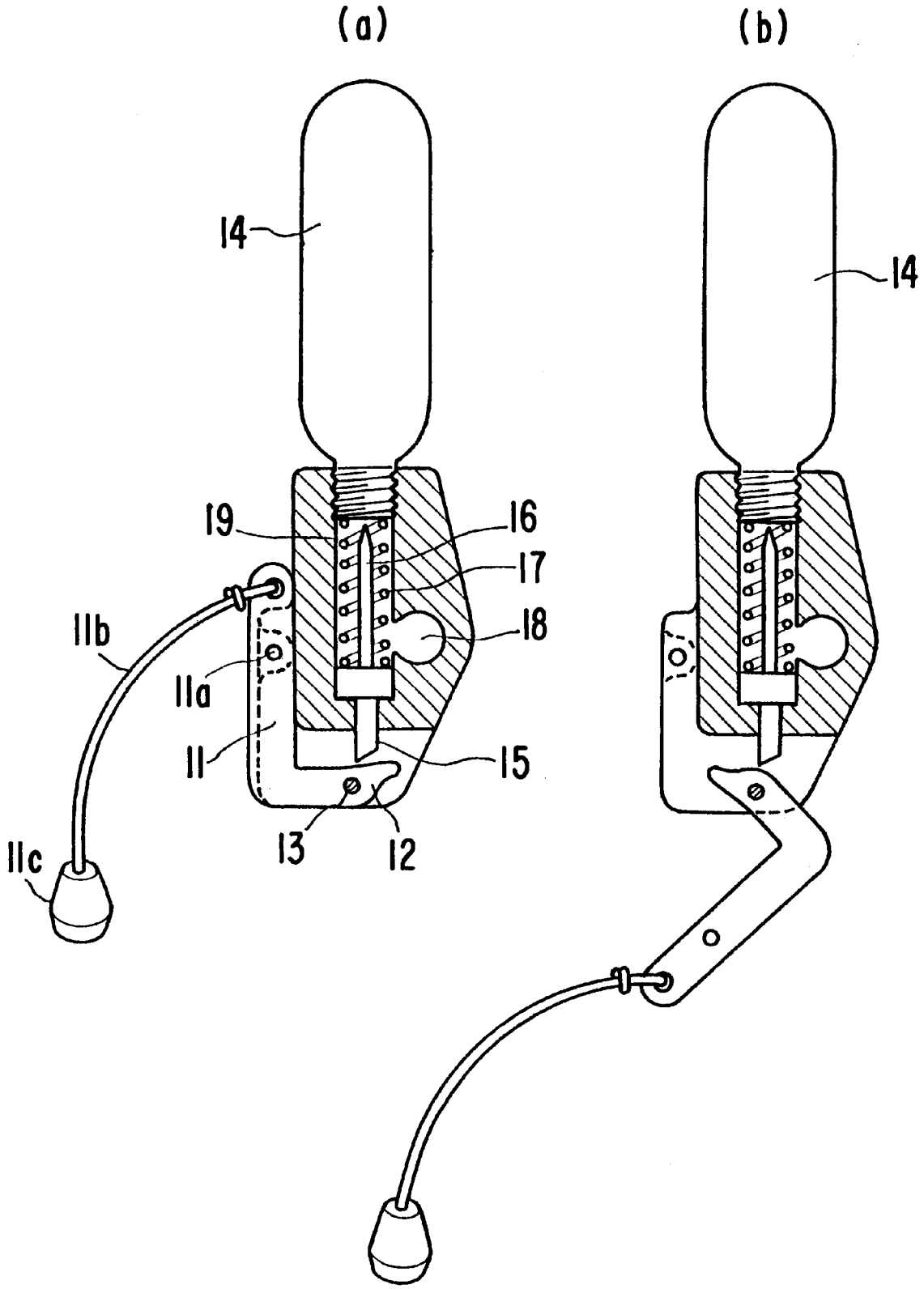
FIG. 11(*a*)–11(*b*) are sections that illustrate; the internal structure of the gas charging apparatus.

FIGS. 11(*a*) and 11(*b*) are perspective interior views of the gas charging apparatus 9, with FIG. 11(*a*) showing the gas charging apparatus 9 before it is operated and FIG. 11(*b*) showing the gas charging apparatus 9 after it is operated. 12 is a cam, 15 is a thrust pin, 16 is an insert needle, 17 is a spring, 18 is a coupling hole, and 19 is a cylinder.

To operate the gas charging apparatus 9, the safety pin is withdrawn from the safety pinhole 11*a* and the pull-piece 11*c* of the pull-cord 11*b* is pulled. This rotates the lever 11 about the shaft 13, causing the cam 12 on end of the lever 11 to push the thrust pin 15 up against the resistance of the spring 17, forcing the tip of the insert needle 16 through a seal on the nozzle of the cylinder 14. As a result, compressed carbon dioxide jets out, filling the gas bag 8 connected to the gas charging apparatus 9. A gas cylinder 14 that is used up can of course be replaced by a fresh one.

Thus, the rucksack provided with a disaster-protection hood in accordance with the present invention has the configuration described in the foregoing. The rucksack with the disaster-protection hood is carried in a way that enables the hood to be used promptly to protect the head of the user by means of a simple operation that can readily be done by anyone regardless of age or whether the user is physically impaired, thereby providing protection in the event of an earthquake, a fire, a flood, a volcanic eruption or other such disaster.

What is claimed is:

1. A rucksack comprising:

a rucksack body;

a hood including a head-cover portion, a nape-of-the-neck portion and face side flaps;

a hood containment strip between said hood and said rucksack body, said hood containment strip having a first end connected to a lower portion of said nape-of-the-neck portion and a second end connected by a connective strip to said rucksack body, and said hood containment strip having opposite side edges extending between said first and second ends;

fastening structure provided along said opposite side edges of said hood containment strip, such that upon said hood containment strip being folded upon itself along a middle portion thereof between said first and second ends thereof said fastening structure brings said opposite side edge portions into mutual engagement to define a containment enclosure to receive said hood; and a gas charging apparatus for charging gas into said head-cover portion, said nape-of-the-neck portion and said face side flaps, to thereby form a cushioned disaster-protection hood.

2. A rucksack as claimed in claim 1, wherein said fastening structure comprises a touch-close fastener.

3. A rucksack as claimed in claim 1, wherein said fastening structure extends along the entire length of said opposite side edges.

4. A rucksack as claimed in claim 1, wherein said hood includes two layers separated by a gas bag into which may be charged said gas.

5. A rucksack as claimed in claim 4, wherein said gas bag comprises a plurality of mutually-communicating compartments.

6. A rucksack as claimed in claim 1, further comprising a zipper detachably connecting said first end of said hood containment strip to said nape-of-the-neck portion.

* * * * *